US006085945A

United States Patent [19]

Fransen

[11] Patent Number: 6,085,945

[45] Date of Patent: Jul. 11, 2000

[54] DISTRIBUTER FOR A PRODUCT INCLUDING A PRESSURE BAG AND A NON-RETURN VALVE

[75] Inventor: Alfons Jozef Ida Fransen, Bornem, Belgium

[73] Assignees: Alfons Jozef Ida Fransen; Paul Alfons Mathilde Cornelis, both of Belgium

[21] Appl. No.: 08/945,754

[22] PCT Filed: May 8, 1996

[86] PCT No.: PCT/BE96/00049

§ 371 Date: Jan. 2, 1998

§ 102(e) Date: Jan. 2, 1998

[87] PCT Pub. No.: WO96/35627

PCT Pub. Date: Nov. 14, 1996

[30] Foreign Application Priority Data

May 9, 1995 [BE] Belgium ..... 9500411

[51] Int. Cl.[7] ..... B65D 83/00; B65B 1/04

[52] U.S. Cl. ..... 222/402.18; 222/402.16; 141/20

[58] Field of Search ..... 222/402.1, 402.18, 222/402.16; 141/20

[56] References Cited

U.S. PATENT DOCUMENTS 3,235,137 2/1966 Bonduris .
3,245,435 4/1966 Healy .
3,610,481 10/1971 Marraffino .

*Primary Examiner*—Kevin Shaver
*Assistant Examiner*—Keats Quinalty
*Attorney, Agent, or Firm*—Bacon & Thomas PLLC

[57] ABSTRACT

A distributor for a product under pressure has a receptacle which defines a receiving volume. A valve having a springy press-on valve shaft and a non-return valve part is mounted on the receptacle. A passage through which the valve shaft may communicate with the receiving volume is provided. A valve seating section is arranged such that the passage is closed off when the valve shaft is in a rest position and is open when the valve shaft is pressed on. A flexible bag which defines an interior space is provided within the receptacle with the valve seating section outside the bag, and the bag is connected to the valve shaft by the non-return valve part such that flow of a pressurized medium may flow through the valve shaft toward the interior space, but reverse flow is blocked. Flow of pressurized medium out of or into the receptacle through the valve shaft may be obtained without releasing pressure from the pressurized bag.

13 Claims, 5 Drawing Sheets

DISTRIBUTER FOR A PRODUCT INCLUDING A PRESSURE BAG AND A NON-RETURN VALVE

BACKGROUND OF THE INVENTION

1. Field of the Invention

The invention relates to a distributor for a product under pressure. More specifically, the invention relates to such a distributor formed by a receptacle upon which a valve having a springy, press-on valve shaft and a non-return valve part is mounted.

2. Description of the Related Art

A known embodiment of a distributor has a receptacle with a valve mounted thereupon. The valve has a springy, press-on valve shaft which is connected to a receiving volume of the receptacle by a passage. The passage may be closed off by a valve part when the valve shaft is in a rest position, but is open when the valve shaft is pressed on. A flexible bag is provided in the receptacle. The inside of the bag is connected to an end of the valve shaft situated in the receptacle. The passage is situated outside the bag.

A distributor of this kind is disclosed in U.S. Pat. No. 3,610,481. This distributor is intended for the simultaneous dispersion of two products through the valve, one product from the bag and one product from the space in the receptacle around the bag.

Therefore, the bag connects to the end of the valve shaft through an intermediary of a second valve part which also is closed off when the valve shaft is in a rest position and is open when the valve shaft is pressed on.

The bag is collapsible under the influence of the pressure surrounding it in the container. This pressure decreases when product from the container is dispensed.

Such a distributor cannot be used for dispensing a single product by a pressure medium. It is clear that, as both vale parts are open when the valve shaft is pressed on, the bag cannot be used for containing a pressure medium which would escape very quickly when product is dispensed.

Known distributors for dispensing a single product, for example spray cans, do not comprise a bag inside the receptacle. A propellant under pressure is put in the receptacle via the valve shaft and the open valve part after the receptacle has been filled with a product.

Thus the propellant comes into contact with the product, which is undesirable in a number of cases.

The invention aims to remedy this disadvantage and to provide a distributor wherein the propellant under pressure and the product are separated and which has a relatively simple construction.

SUMMARY OF THE INVENTION

This aim is reached according to the invention as the bag is a pressure bag which defines an interior space for receiving a pressure medium and the valve includes a non-return valve part by which the valve shaft is connected to the interior space of the pressure bag. The non-return valve part allows flow only towards the pressure bag.

When the distributor is filled, the closable passage connects to the product provided in the receptacle.

The pressure bag makes sure that the product in the receptacle is put under pressure. Therefore, the product may be distributed in the usual manner by pressing on the valve shaft.

As the product is situated around the pressure bag, it is possible to first put the product in the receptacle and to only then provide the valve with the pressure bag and to put the receptacle under pressure by filling the pressure bag. Thus, the product does not necessarily need to be inserted through the valve.

This makes the distributor particularly suited for viscous products, subsequent foaming and curing products, curing products such as polyurethane foams, sealing compounds and food.

Such products may cause problems if they are inserted through the valve. The valve may be obstructed as the product cures or may be soiled by the product. Food may contaminate the valve with bacteria.

As charging times are too lengthy and evacuation is too slow, due to the restricted inflow and outflow of conventional valves for highly viscous products, including among others polyurethane foams, sealing compounds and food, these valves cannot be used for such products in practice.

The invention avoids these disadvantages.

Moreover, a gas which is environmentally sound and safe, i.e. non-toxic, inexplosive, non-flammable, may be provided in the pressure bag. Such gases include air, nitrogen and carbon dioxide.

If the distributor is used for polyurethane foam, the composition requires less pressure gas, since the evacuation force is supplied by the pressure bag in which the gas remains under pressure.

The pressure bag is provided in the receptacle while it is still empty. After it has been filled with a pressure medium, namely gaseous gas under pressure, gas-producing liquid or liquid gas, the pressure bag may be closed off. Preferably the valve contains a non-return valve part with which the valve shaft is connected to the interior space of the pressure bag and which allows flow only towards the pressure bag in the receptacle.

After the pressure bag and the product have been provided in the receptacle and the receptacle has been closed off with the valve, the pressure bag may be filled with gas under pressure or a gas-producing liquid via the non-return valve part.

The valve may have an attachment element on an internal end of the valve shaft to which the pressure bag may be fixed. The non-return valve part is mounted in the attachment element in such as case.

In a particular embodiment, the valve contains a membrane, preferably a rubber sealing plug, with which the pressure bag is closed off in the receptacle even before the pressure bag is filled with gas under pressure.

In this embodiment, the gas under pressure is provided in the pressure bag by a needle with is pricked through the membrane. After the needle has been removed, the sealing of the pressure bag by the membrane is automatically repaired.

BRIEF DESCRIPTION OF THE DRAWINGS

In order to better show the characteristics according to the invention, some preferred embodiments are described hereafter as examples without any limitative character whatsoever, references being made to the accompanying drawings in which.

DETAILED DESCRIPTION OF THE PREFERRED EMBODIMENTS

Figure 1:
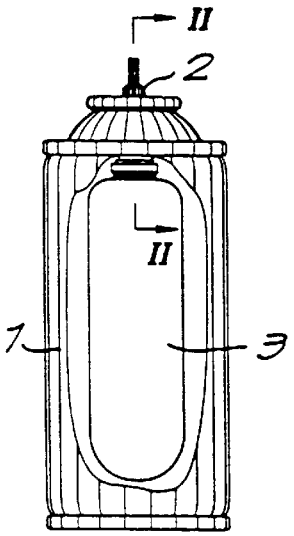
FIG. 1 is a schematic representation of a distributor according to the invention, with a partial cut-out.

The distributor represented in FIG. 1 comprises a receptacle 1 which defines a receiving volume for a product to be distributed, usually in the form of a liquid, a powder, a cream, a gel or a mixture of separate ingredients to be inserted; a valve 2 mounted thereupon; and a flexible pressure bag 3 attached to valve 2 inside receptacle 1.

In the example shown, receptacle 1 has the form of a spray can. However, the receptacle may also have another shape, and may for example be a flexible bag.

Figure 2:
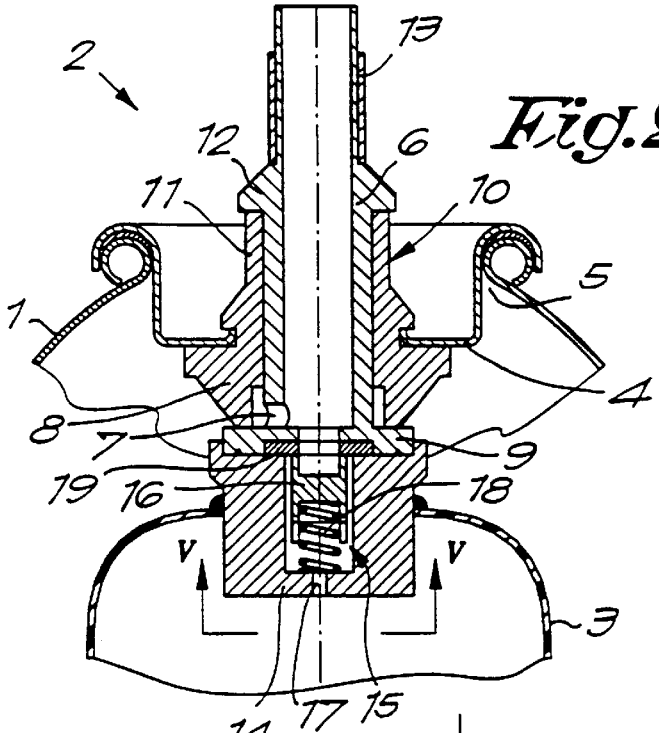
FIG. 2 shows a section to a larger scale according to line II—II in FIG. 1.
Figure 4:
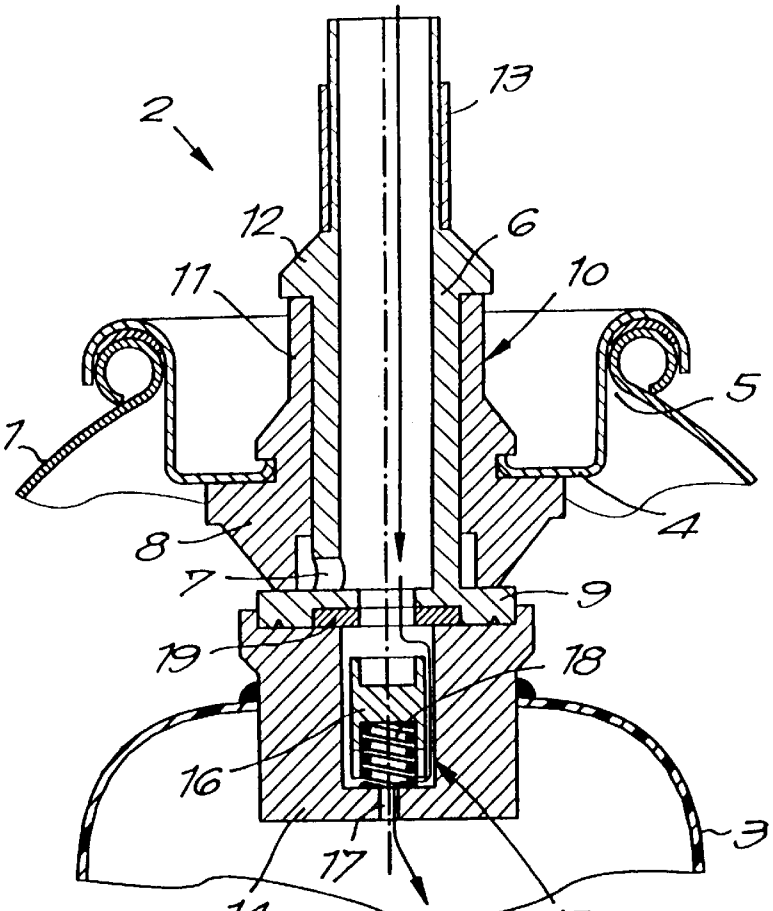
FIGS. 3 and 4 show sections analogous to that of FIG. 2, but during the filling with product and during the filling of the pressure bag with gas under pressure, respectively, and drawn to a larger scale.
Figure 3:
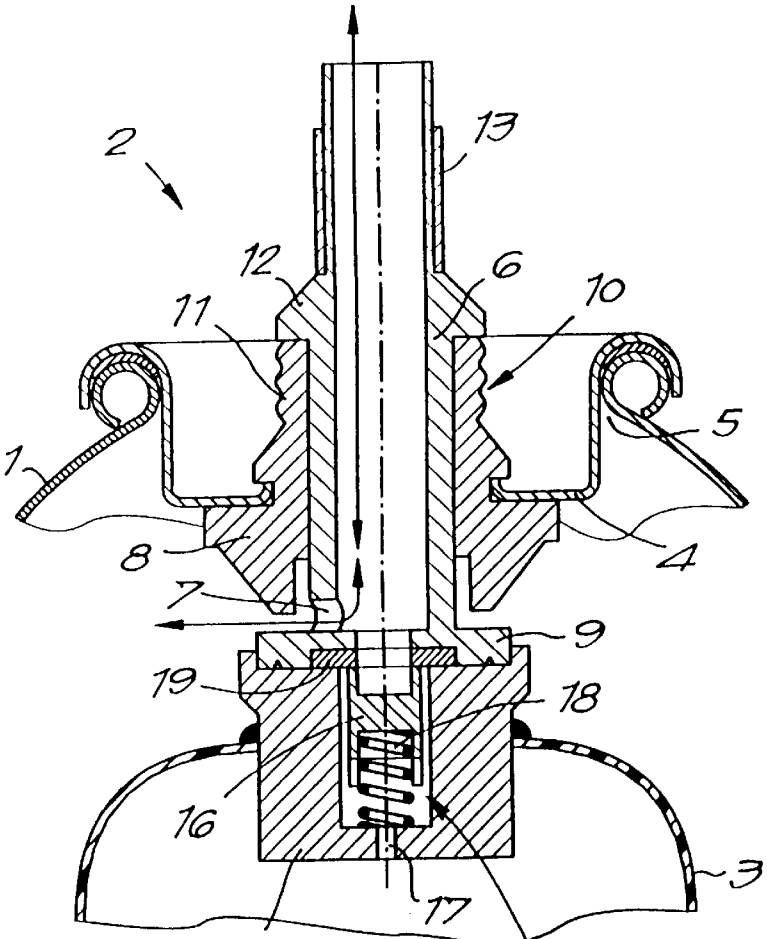

As is represented in greater detail in FIGS. 2 to 4, valve 2 is mounted in a dish-shaped collar 4 whose edges are rolled up over edges of an opening 5 in receptacle 1, but naturally, valve 2 may also be fixed to the receptacle in other manners.

Valve 2 contains a springy press-on valve shaft 6 which is connected to the receiving volume of receptacle 1 via a passage 7. Passage 7 comprises one or several openings provided in a side wall of valve shaft 6 which may be closed off by cooperating valve seating sections 8, 9.

A closing device 10 made of elastic material, in particular of rubber, situated inside receptacle 1 is clamped on dish-shaped collar 4 and surrounds press-on valve shaft 6. An upper valve portion 8 of closing device 10 forms a second seating element cooperating with a first valve seating section 9 moveable with valve shaft 6.

A lower valve portion of valve sections 8, 9 comprises a valve collar 9 standing at an internal end of valve shaft 6, under passage 7, and connecting onto upper valve portion 8 in a closing position so as to close off passage 7.

An upper section 11 of closing device 10 situated outside receptacle 1 is situated between a bottom of dish-shaped collar 4 and a shaft collar 12 on an outer end of valve shaft 6. Upper section 11 has the function of a spring which counteracts the pressing on valve shaft 6.

The outer end of valve shaft 6 is reinforced by a casing 13 provided around it. A head with a spray element, not represented in the drawings, may be provided at the outer end so as to atomize the product distributed via valve shaft 6.

Pressure bag 3 is fixed to valve shaft 6 by an attachment element 14 which is fixed to valve collar 9, with glue for example. A non-return valve part 15 is provided in attachment element 14.

Non-return valve part 15 contains a valve element 16 which is mounted with some clearance in a bore 17 which extends centrally through attachment element 14 and which connects valve shaft 6 to the interior space of pressure bag 3.

A spring 18, which is mounted between valve element 16 and a narrowing of bore 17, pushes valve element 16 against a seating formed by a sealing ring 19. Sealing ring 19 is countersunk in valve collar 9 and is partly situated in bore 17.

Figure 5:
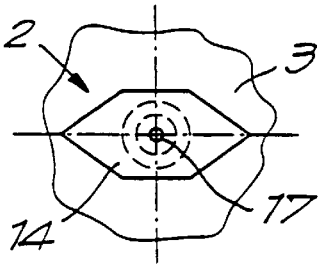
FIG. 5 shows a section according to line V—V in FIG. 2.

Attachment element 14 may have various forms and may have a longitudinal section, as represented in FIG. 5, which is pointed on both ends.

Pressure bag 3 may be fixed to attachment element 14 in various manners, such as by welding or gluing, or mechanically by snapping, pressing, rolling, stapling, etc.

Pressure bag 3 may be made of an elastic material, may comprise several layers and may be provided with a gas screen.

Its form is adapted to the form of receptacle 1. The pressure bag may be provided with a folding or block bottom.

The use of the distributor is as follows:

In a rest position, as represented in FIG. 2, valve sections 8,9 closes off passage 7, whereas valve element 16 of non-return valve part 15 connects to sealing ring 16 and closes off bore 17.

The interior space in pressure bag 3 is filled with gas under pressure and receptacle 1 is filled with product around pressure bag 3.

In order to distribute the product, valve shaft 6 must be pressed on or pushed aside.

As a result, upper section 11 of closing device 10 is elastically compressed and valve sections 8, 9 are opened so that passage 7 is opened, as represented in FIG. 3.

Because of the pressure in pressure bag 3, non-return valve part 15 remains closed and no gas escapes from pressure bag 3.

As the product is released from receptacle 1, pressure bag 3 expands until it fills almost the entire receptacle when all of the product has been distributed.

Because the gas remains in pressure bag 3, receptacle 1 may be filled again with product after it has been emptied, whereby this product will press pressure bag 3 together.

It is clear that when valve shaft 6 is pressed on, the product may not only escape from receptacle 1, but may also enter it. Consequently, receptacle 1 may be filled via passage 7 or another product can be inserted, for example a product which reacts with the product which is already present in the receptacle so as to obtain foam.

Valve 2 is a double-action valve, which implies that it may be used both to distribute the product as described above and to fill the pressure bag.

By connecting a source of gas under pressure to valve shaft 6 without pressing on the valve shaft and, if necessary, keeping closing device 10 pressed against valve collar 9, non-return valve part 15 will be opened due to the pressure and pressure bag 3 may be inflated.

Valve element 16 is pushed away from sealing ring 19 so that gas may flow along the valve element through bore 17, as represented in FIG. 4.

Consequently, the distributor can also be composed as follows:

Receptacle 1 may be filled with the product first, after which valve 2, possibly with dish-shaped collar 4, is provided. Pressure bag 3 is folded, rolled up or held together as a small package in any other manner so that it an be put in the receptacle through opening 5 or through dish-shaped collar 4.

Afterwards, pressure bag 3 is filled with gas under pressure which is supplied via non-return valve part 15.

It is also possible to first provide valve 2 in the above-described manner and fill receptacle 1 only then with the product via passage 7.

The variants of the distributor represented in FIGS. 6 to 15 only differ from the embodiment according to FIGS. 2 to 5 in that valve 2 has another shape, in particular attachment element 14 and non-return valve part 15.

Figure 6:
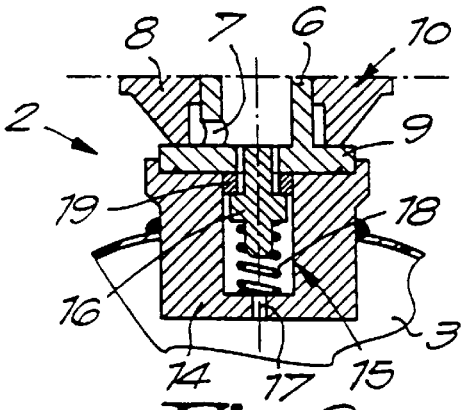
FIGS. 6 to 11 show a section of a lower part of a valve of a distributor according to the invention but with reference to different variants of the valve of FIGS. 1 to 4.

Thus, in the embodiment according to FIG. 6, sealing ring 19 is situated at a lower side of valve collar 9. Valve element 16 penetrates partly in valve shaft 6.

Figure 12:
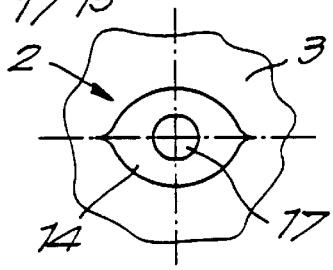
FIGS. 12 to 15 show sections according to the lines XII—XII, XIII—XIII, XIV—XIV and XV—XV, respectively, in the FIGS. 7 to 11.
Figure 7:
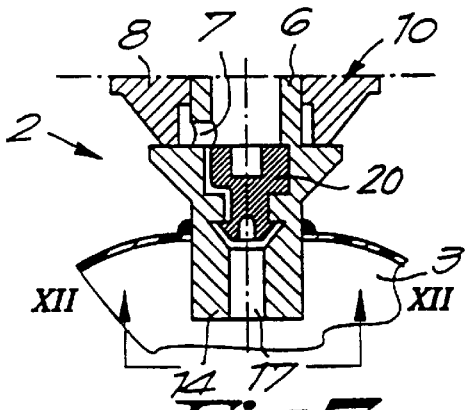

In the embodiment according to FIGS. 7 and 12, attachment element 14 is made in one piece with valve shaft 6 and has a section in the shape of an ellipse with wings on the ends. Moreover, valve element 16 and spring 18 are replaced by a rubber gudgeon 20 which closes off bore 17 in a rest position, but is pushed away and deformed under pressure such that an opening and thus a passage for gas is created.

Figure 13:
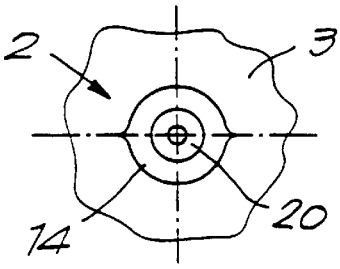
Figure 8:
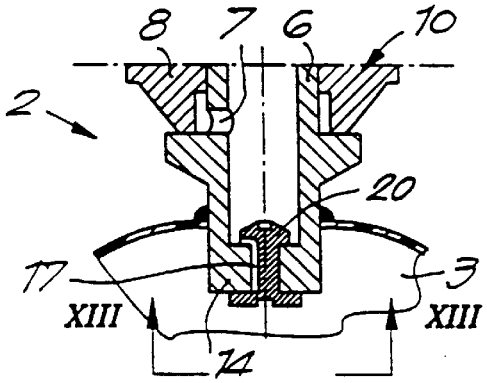

The embodiment according to FIGS. 8 and 13 differs from the preceding one in that attachment element 14 has another shape, a section which is round with two diametrically situated wings. Valve element 16 of non-return valve part 15 comprises rubber gudgeon 20 and is mounted in a lower end of attachment element 14.

Figure 14:
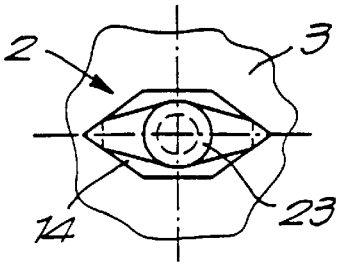
Figure 9:
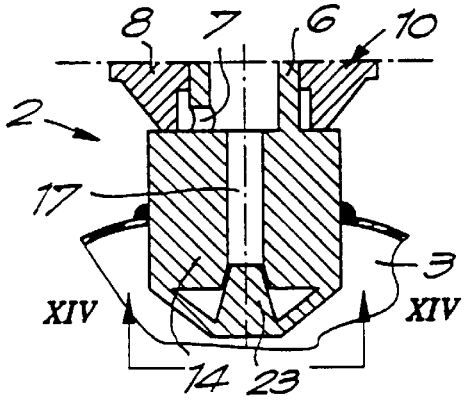

In distributing valve 2 represented in FIGS. 9 and 14, attachment element 14 is made at least partially of elastic material and valve element 16 of non-return valve part 15 is made of an elastically deformable part 23 of attachment element 14.

Figure 15:
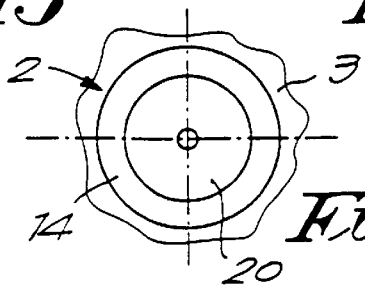
Figure 10:
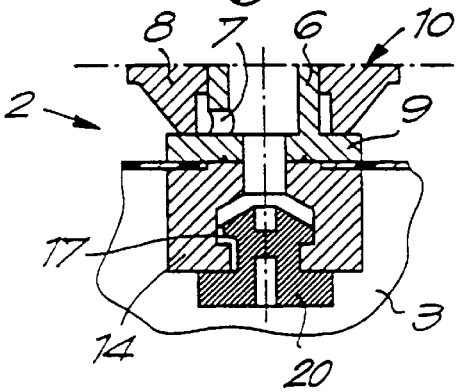
Figure 11:
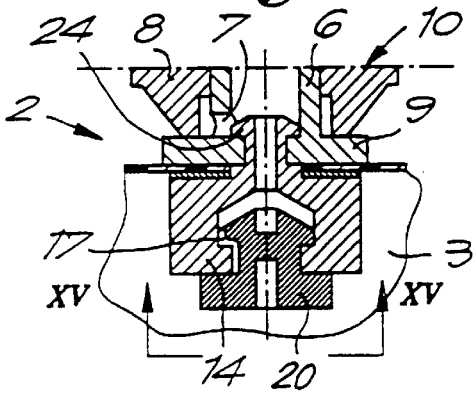

In the embodiments according to FIGS. 10, 11 and 15, the valve element of non-return valve part 15 is also formed of rubber gudgeon 20, but attachment element 14 is separate from valve shaft 6.

Pressure bag 3 is clamped between attachment element 14 and valve collar 9. In FIG. 10, attachment element 14 and valve collar 9 are welded or glued together, whereas in FIG. 11, attachment element 14 is snapped on valve collar 9 with a protrusion 24.

Pressure bag 3 does not necessarily need to be filled with gas under pressure. It may also be filled with liquid gas or with gas in a solution.

As is already clear, attachment element 14 may also be separate from valve collar 9.

It may even be disconnected from it, whereby a connecting piece is provided between attachment element 14 and valve collar 9. Pressure bag 3 may be separate and may be connected to the connecting piece or directly to valve shaft 6 or valve collar 9 by a connecting piece or a tube situated inside the bag. In the latter case, non-return valve part 15 may be situated in the above-mentioned connecting piece or the above-mentioned tube.

Figure 16:
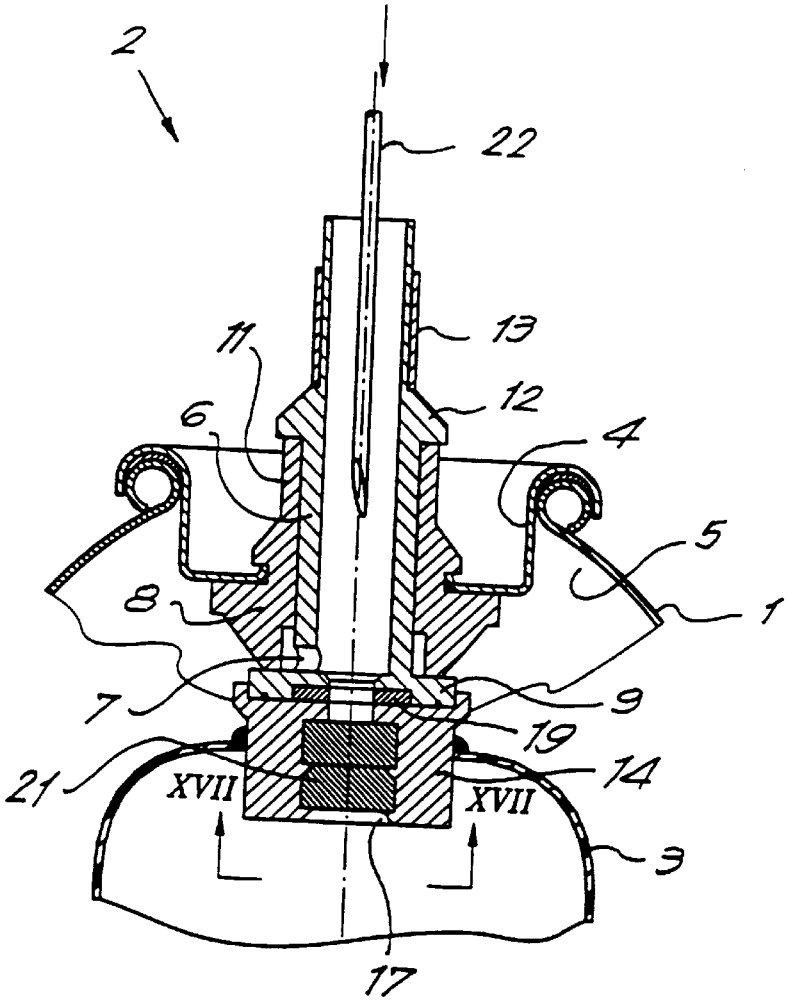
FIG. 16 shows a section similar to that in FIGS. 2, 3 and 4, but with reference to another embodiment of the invention.
Figure 17:
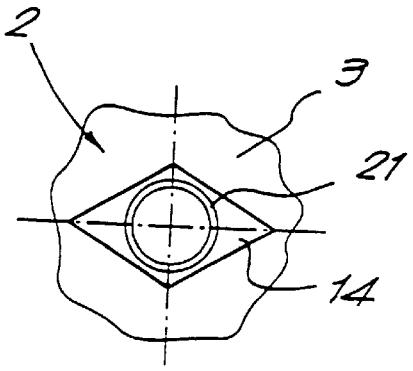
FIG. 17 shows a section according to line XVII—XVII in FIG. 16.
Figure 18:
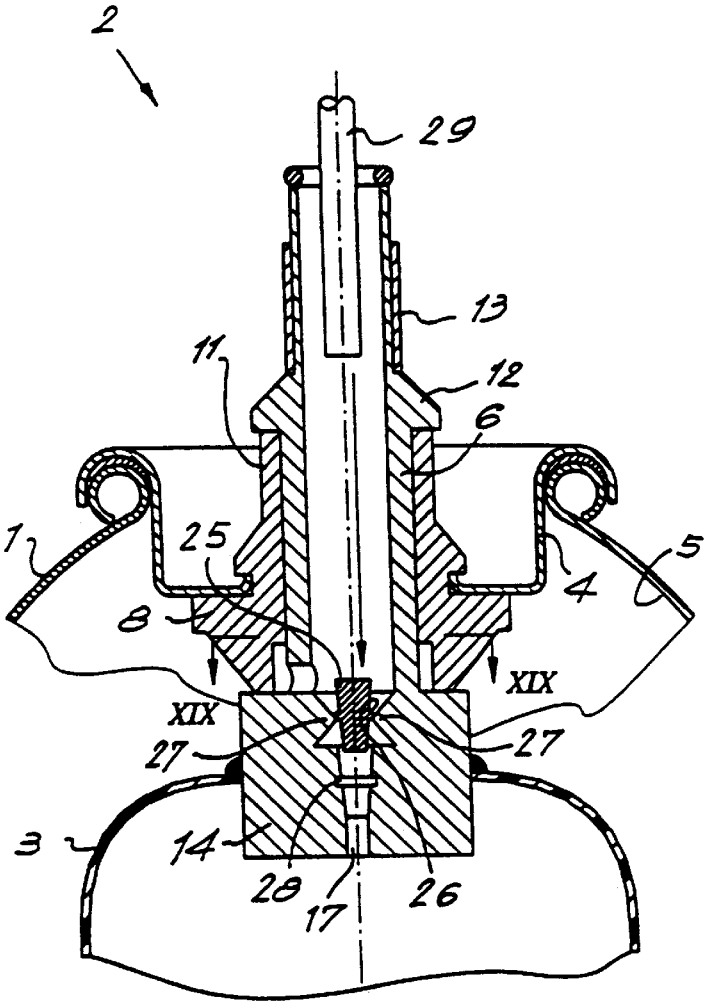
FIGS. 18 and 19 show parts of a section similar to that in FIG. 16, but for two variants according to the invention.

The embodiment represented in FIGS. 16 to 18 differs from the above-described embodiments in that non-return valve part 15 has a different construction.

The construction of the latter is analogous to the embodiments according to FIGS. 7 to 15, whereby non-return valve part 15 comprises a gudgeon, but elastic gudgeon 25 is open before pressure bag 3 is filled.

As represented in FIGS. 16 and 17, gudgeon 25 may be wedge-shaped and may be provided all around with a rib 26 with which it rests on or is clamped between four radial protrusions 27 extending in a top part of bore 17 of attachment element 14.

A lower part of bore 17 has a shape in which gudgeon 25 fits. This part of bore 17 has a groove 28 in which rib 26 fits.

If the receiving volume between pressure bag 3 and receptacle 1 is filled via valve 2 with a product or a component such as foam gas when the receiving volume is already filled with polyurethane or such, a pressure which is sufficiently low for gudgeon 25 to remain in the above-mentioned position is used.

If required, the product or the component may be prevented from entering in pressure bag 3 in this case by closing off bore 17 around gudgeon 25 with a membrane which resists the above-mentioned pressure, but through which the gas with which pressure bag 3 is filled may penetrate.

The pressure bag is filled with gas at a pressure which is sufficiently high to penetrate the membrane, but which is nonetheless sufficiently low for gudgeon 25 to remain in place. This gas flows between radial protrusions 27 through bore 17.

The pressure bag is filled as described above with a filling device which is connected to valve 2, but which moreover contains a moveable pen 29 which is pushed in valve shaft 6 after the filling and with which gudgeon 25 is pushed past radial protrusions 27 while being elastically deformed until it is pressed in the lower end of bore 17 and closes off this bore hermetically and permanently.

Figure 19:
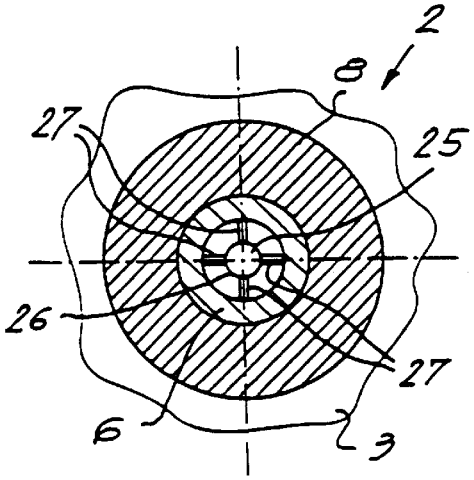

The variant represented in FIG. 19 differs from the preceding embodiment in that bore 17 and gudgeon 25 have another shape. They are both cylindrical, but gudgeon 25 is provided with axial grooves 30 on a lower perimeter. Bore 17 is closed off with a membrane 31 at a top end.

While a product or a component is provided through valve 2, gudgeon 25 rests on membrane 31. As pressure bag 3 is filled, membrane 31 is broken. However, the position of gudgeon 25 does not change, for example because its diameter is slightly larger than the diameter of bore 17 or because it is still connected to valve shaft 6 by a connecting piece.

The gas may flow through grooves 30 in bore 17. When pressure bag 3 is filled, gudgeon 25 is forcefully pushed in bore 17 by pen 29.

According to a variant, bore 17 may be made such that gudgeon 25 may take up an intermediate position which is occupies after membrane 31 has been broken and while the pressure bag is being filled.

As described above, gudgeon 25 may be a separate element. According to a variant, it may be made in one piece with the valve shaft and may be broken off from the valve shaft as pen 29 is pressed in.

In the embodiment according to FIG. 18, the valve element is not a gudgeon, but comprises an annular ridge 32 which is part of attachment element 14, which in this case may form a whole with valve shaft 6. Annular ridge 32 surrounds an orifice defined by the top end of bore 17 and thus extends in valve shaft 6. Annular ridge 32 is made of thermoplastic material.

Pen 29 of the filling mechanism is heated and, after pressure bag 3 has been filled, annular ridge 32 is weakened by heated pen 29 and flattened such that it closes off the orifice and bore 17.

Naturally, the present invention is by no means limited to the embodiments described above and represented in the accompanying drawings; on the contrary, such a distributor for products under pressure may be made in various forms and dimensions while still remaining within the scope of the invention.

In particular, valve 2 may be provided with a discharge control and/or a closing device of valve shaft 6.

What is claimed is:

1. A distributor for a product under pressure, comprising:

a receptacle which defines a receiving volume;

a valve mounted on said receptacle, said valve having a springy press-on valve shaft;

a passage through said valve shaft via which communication between said receiving volume and the exterior of the receptacle may be established;

said valve including a first seating section arranged such that said passage is closed off by said first seating section in cooperation with a second seating element when said valve shaft is in a rest position and said passage is open when said valve shaft is pressed on; and a flexible pressure bag for receiving a pressurized medium and which defines an interior space, said flexible bag located within said receptacle and said space connected to said passage by a non-return valve that is arranged to permit flow of a pressurized medium towards the space via the passage but not reverse flow out of the space, and wherein said valve first seating section is located outside said pressure bag.

2. A distributor according to claim 1, wherein said valve includes an attachment element at an internal end of said valve shaft, said pressure bag being fixed to said attachment element.

3. A distributor according to claim 2, wherein said attachment element and said valve shaft are formed as a single piece.

4. A distributor according to claim 2, wherein said non-return valve is mounted in said attachment element.

5. A distributor according to claim 4, wherein said non-return valve comprises a moveable gudgeon moveable between a first position whereat open communication is established between said passage and said bag interior space and a second position whereat flow of a pressure medium out of said space toward said passage is blocked.

6. A distributor according to claim 2, wherein said non-return valve comprises a valve sealing element formed by an elastically deformable part of said attachment element.

7. A distributor according to claim 2, wherein said attachment element includes a permanently sealable orifice that provides communication between said bag interior space and said passage, said sealable orifice constituting said non-return valve.

8. A distributor according to claim 7, wherein said orifice is integrally formed as part of said attachment element and is sealable by deformation of a portion of said attachment element defining said orifice.

9. A distributor according to claim 1, wherein said non-return valve comprises:

a non-return valve seat carried by said valve shaft; and a non-return valve sealing element normally urged against said non-return valve seat.

10. A distributor according to claim 1, wherein said non-return valve includes a valve sealing element formed by an elastic gudgeon, said gudgeon being arranged such that said passage is in communication with said space when pressure is applied from the direction of said passage towards said gudgeon.

11. A distributor according to claim 1, including:

a receptacle closing device formed of elastic material surrounding said valve shaft and spanning the space between the valve shaft and the receptacle, said closing device including said second seating element located inside said receptacle.

12. A distributor according to claim 11, wherein said receptacle closing device includes an upper section located outside said receptacle and arranged to elastically counteract pressure exerted on said valve shaft.

13. A distributor according to claim 1, including:

a product provided between said pressure bag and an inside wall of said receptacle such that said receiving volume is filled; and a pressurized medium in said pressure bag interior space.

* * * * *